US009150288B2

(12) United States Patent
Barr

(10) Patent No.: US 9,150,288 B2
(45) Date of Patent: Oct. 6, 2015

(54) SURFBOARD HAVING INTERCHANGEABLE TAIL EXTENSIONS

(71) Applicant: David Barr, Carlsbad, CA (US)

(72) Inventor: David Barr, Carlsbad, CA (US)

( * ) Notice: Subject to any disclaimer, the term of this patent is extended or adjusted under 35 U.S.C. 154(b) by 0 days.

(21) Appl. No.: 14/220,159

(22) Filed: Mar. 20, 2014

(65) Prior Publication Data

US 2014/0315454 A1 Oct. 23, 2014

Related U.S. Application Data

(60) Provisional application No. 61/814,686, filed on Apr. 22, 2013.

(51) Int. Cl.
*B63B 35/79* (2006.01)
*A63C 5/03* (2006.01)

(52) U.S. Cl.
CPC ..... *B63B 35/7906* (2013.01); *A63C 5/03* (2013.01); *B63B 35/7916* (2013.01)

(58) Field of Classification Search
CPC .... B63B 35/7906; B63B 35/74; B63B 35/81; B63B 35/73; B63B 1/00; B63B 35/79; B63B 35/7926; A63C 5/03
USPC ..... 441/65, 74; 280/601
See application file for complete search history.

(56) References Cited

U.S. PATENT DOCUMENTS

| | | | | |
|---|---|---|---|---|
| 3,879,782 | A * | 4/1975 | Oliver | 441/74 |
| 2006/0189228 | A1 * | 8/2006 | Murphy et al. | 441/65 |
| 2010/0173545 | A1 * | 7/2010 | Castanho | 441/74 |

* cited by examiner

*Primary Examiner* — Lars A Olson
(74) *Attorney, Agent, or Firm* — Mark R. Huebscher; TechLaw LLP

(57) ABSTRACT

A riding board such as a surfboard extending from a tip or front end longitudinally to a tail or rear end. The rear end terminates at a board interface plate that is incorporated into and as part of the riding board. The board interface plate is adapted to be either the tail section of the riding board or alternatively, a coupling means for connecting a tail block to the rear end of the board. The board interface plate includes a plurality of spaced apart coupling cavities that extend inwardly into the riding board body from the rear end. The surfboard may also be used with an interchangeable tail block having a tail faceplate that interfaces and couples with the interface plate on the surfboard. The tail block may be configured to most any desired tail configuration, size and shape.

11 Claims, 7 Drawing Sheets

SURFBOARD HAVING INTERCHANGEABLE TAIL EXTENSIONS

This application claims priority to U.S. patent application No. 61/814,686 filed Apr. 22, 2013 entitled Interchangeable Tail System for Surfboards and Other Riding Boards, the contents of which are incorporated herein by reference in its entirety.

FIELD OF THE INVENTION

The present invention relates generally to personal riding boards such as surfboards, paddleboards, stand up paddleboards, snowboards, wake boards and more specifically to a personal riding board having the ability to be uniquely configured by adding or removing a variety of interchangeable rear sections or tail blocks.

BACKGROUND

Conventional riding boards come in a variety of shapes and sizes, each having its own set of characteristics. A key component of these riding boards is the tail section as it shape and configuration significantly impacts the board's riding characteristics. Moreover, the tail section also affects the riding board's length and shape. As a result, the tail section of most personal riding boards, and particularly surfboards, can be provided in a variety of shapes, each tailored to provide a desired riding characteristic. For example, a "squash tail" on a surfboard is generally known to allow a surfer to perform sharper turns and is often preferred on smaller to medium sized waves while an elongated "pin tail" is often preferred for carving turns on larger or more powerful waves. Currently, a rider must have a different riding board to take advantage of the various characteristics provided by each different tail system or block because conventional surfboards are provided with a fixed rear portion or tail. Depending on the manufacturer's preference or design requirement, the tail may be of any shape, thickness, rocker and size. With the increasing price of surfboards, having a variety of boards becomes cost prohibitive.

Another issue with conventional riding boards is damage to the tail section during handling, storage and transportation. Whether sitting in the garage, moving it by car, plane, bicycle or simply transporting it to the riding zone, the tail section of riding boards are notorious for getting damaged. It would be advantageous if the tail section could be replaced with a protective tail cover for such transportation and storage. It would be more advantageous if the riding board could be reduced in size by removing the tail section. It would be even more advantageous if the riding board could be fitted with a removable protective travel tail block. Thus, there is a need for a riding board that can be easily modified for different riding conditions and minimize damage to the riding board tail during transport.

SUMMARY

The following presents a simplified summary in order to provide a basic understanding of some aspects of the claimed subject matter. This summary is not an extensive overview, and is not intended to identify key and/or critical elements or to delineate the scope of the claimed subject matter. Its purpose is to present some concepts in a simplified form as a prelude to the more detailed description that is presented later.

In one aspect of various embodiments, a riding board is provided for use on water, snow or even hard surfaces that has provisions to add a secondary tail section or even a variety of interchangeable tail sections or tail blocks. More specifically, the present disclosure is directed to a riding board that can be used with any variety of removable and interchangeable tail blocks. The riding board of the present disclosure is also advantageously adapted for use without an attached interchangeable tail block. The riding board of the present disclosure is particularly advantageous when used with adjustable fins and the present disclosure contemplates the use of fins having adjustability relative to the tail of the board to adapt for the possible changes in board length, rocker and riding characteristics when used with or without the tail block described herein.

The present disclosure is directed to a configurable surfboard that has a surfboard body extending longitudinally from a front end, or tip, to a rear end or tail. A board interface plate may be connected to the rear end of the surfboard body. The board interface plate has an outer surface that faces outwardly and away from the rear end of the surfboard. The board interface plate also includes a plurality of spaced apart cavities that extend inward from the outer surface of the interface plate and into the surfboard body. The rear end of the surfboard and the attached board interface plate are configured to be the tail section of the surfboard tail. Although the described surfboard is designed to be ridden as is, a removable tail block of desired configuration may optionally be coupled to the board interface plate, changing the riding board's length and changing its riding characteristics.

The outer surface of the interface plate includes a flat surface that is perpendicular to the longitudinal axis of the surfboard allowing for a mating surface without effect on flowing water or air. A plurality of spaced apart fin coupling devices are secured to the surfboard between the front end, or tip, and the rear end, or tail. The surfboard body includes means for coupling a fin or plurality of spaced apart fins to a lower surface of the surfboard body between the tip and rear end. The fin means may include an actual fin or simply a fin box.

The present disclosure further includes a removable and interchangeable tail system, also referred to herein as a tail block, which is adapted to couple to the board interface plate of the riding board. The tail block has a front tail interface plate and extends along the longitudinal axis of the riding board to a rear end of the tail block. The front tail interface plate is adapted to abut and couple with the board interface plate of the riding board. More specifically, the front interface plate of the tail block comprises a flat front face having a plurality of spaced apart coupling members protruding outwardly from the face. The flat front interface is adapted to press flat against the corresponding flat face of the board interface plate on the riding board. The coupling members are adapted to fit within the spaced apart coupling cavities within the board interface plate of the riding board so as to secure the tail block to the riding board and create a riding board having a removable tail extension.

In one embodiment of the present disclosure, the tail block is designed to be a protective tail cover for the rear end, or tail, of the riding board. In another embodiment, the tail block of the present disclosure is designed to be custom shaped and/or designed by the consumer or end user. Any different configuration of the tail blocks allow the riding board to be custom configured for the user and/or the different riding conditions. When engaged, the tail cover plate seals the cavities to prevent water, snow or other contaminants from penetrating into the riding board body. The cavities may be limited in size to prevent tail eddies, turbulence, or other undesirable effects to the riding board. Removable fasteners may secure the tail block or the tail cover plate to the surfboard.

In one aspect of various embodiments, a configurable riding board is provided, the riding board comprising: a riding board body extending longitudinally from a front end to a rear end, with the riding board body further defined by a riding surface and a bottom surface; a board interface plate coupled to the rear end of the riding board body and having an outer surface facing away from the rear end of the riding board body, said interface plate further comprising a plurality of spaced apart cavities extending inwardly from the outer surface on the board interface plate; and a tail block having a forward surface that removably couples to the board interface plate, wherein the forward surface has a plurality of tabs to engage the board interface plate cavities.

In one aspect of various embodiments, a configurable riding board is provided, the riding board comprising: a tail block having a body extending from a forward surface along a longitudinal axis to a rear end and shaped to be a tail of the riding board, wherein the forward surface comprises a plurality of spaced apart coupling members protruding outwardly from the forward surface and adapted to removably engage a plurality of spaced apart cavities within a rear end of a riding board body.

In one aspect of various embodiments, a configurable riding board is provided, the riding board comprising: a riding board body extending along a longitudinal axis from a front end to a rear end; a board interface plate connected to the rear end of the riding board and having a substantially flat rear surface facing away from the rear end, said board interface plate having a plurality of spaced apart receiving means; and a tail block having a forward surface that removably couples to the board interface plate, said forward surface having a plurality of spaced apart coupling means adapted to engage the plurality of spaced apart receiving means.

BRIEF DESCRIPTION OF DRAWINGS

FIG. 2A is an exploded view of an embodiment riding board.

DETAILED DESCRIPTION

In the following detailed descriptions of various embodiments, reference is made to the accompanying drawings that form a part hereof, and in which is shown, by way of illustration, specific embodiments that may be practiced. It is to be understood that other embodiments may be utilized and structural changes may be made without departing from the scope of the present disclosure.

The present disclosure is directed to a riding board, such as a surfboard, that it may be extended or otherwise configured by coupling an interchangeable tail section. In one embodiment of the present disclosure, the riding board may include an interface and coupling system of the present disclosure and may be adapted for use without any tail extension. In another embodiment, a tail block may be coupled to the riding board to create a riding board having different riding characteristics depending on user preference and/or environmental conditions. The present riding board can advantageously be used as part of a surfboard, paddleboard, stand-up paddleboard, snowboard, skim board or any other type of riding board having a rear end or tail section.

Figure 1A:
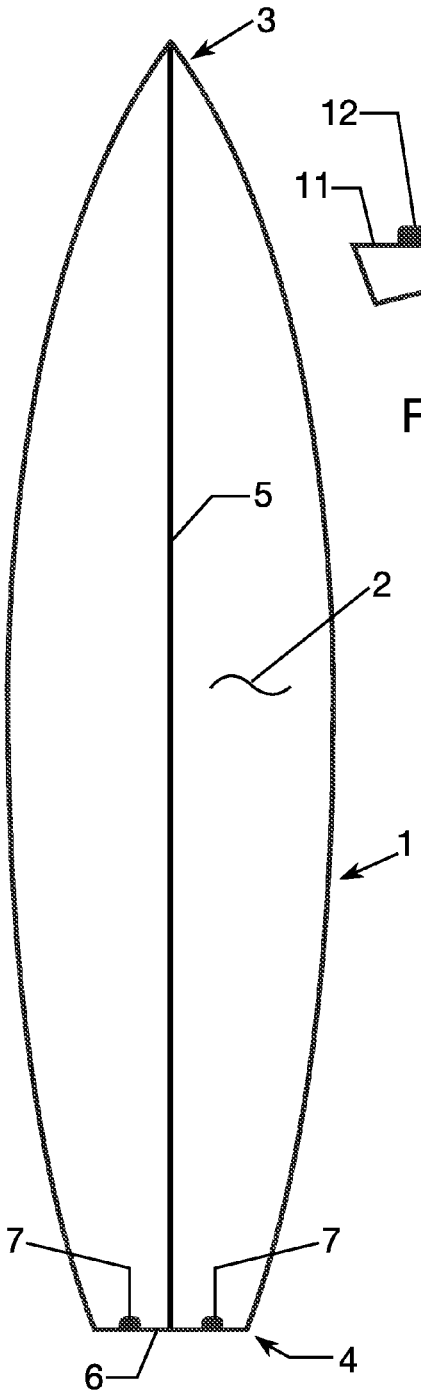
FIG. 1A is a top view of an embodiment riding board.

Referring now to FIG. 1A, top view of an embodiment riding board 1 is shown. The riding board 1 includes a surface of a board body 2 that longitudinally extends from a front end 3 (alternatively referred to as the "tip" or "nose" of the board) to a rear end 4 (alternatively referred to as the "tail" of the board). The board body 2 may be constructed of foam and plastic or resin outer shell, a blown plastic body with a harder outer shell, wood, fiberglass, composite or any material known for making riding boards.

A stringer 5 may extend longitudinally along the board body 2. The stringer 5 may be for structural or cosmetic purposes as is known in the art. For surfboards, paddleboards and stand up paddle boards, construction techniques that are well known in the art may be used including having a shaped or formed foam core surrounded by a covering material such as fiberglass, epoxy, plastic, resin, fiber cloth, and so forth.

A cover plate 42 (see FIG. 6) may be advantageously located at the rear end 4 of the riding board 1. The cover plate 42 may also be used to perform as the tail 4 of riding board 1. The cover plate 42 also provides stability and prevents undesirable drag, and will protect the rear end or tail during transportation. Moreover, the cover plate 42 prevents sand or other debris from entering into and/or contaminating the spaced apart cavities 7. The cover plate 42 also may be adapted to protect interface plate 6 and support the board 1 when set or stored in an upright position to improve the well-known problems of cracking or otherwise damaging the tail 4 when placing the board 1 on the ground.

Figure 1B:
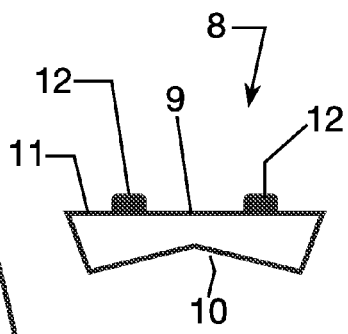
FIG. 1B is a top view of an embodiment interchangeable tail block.
Figure 6:
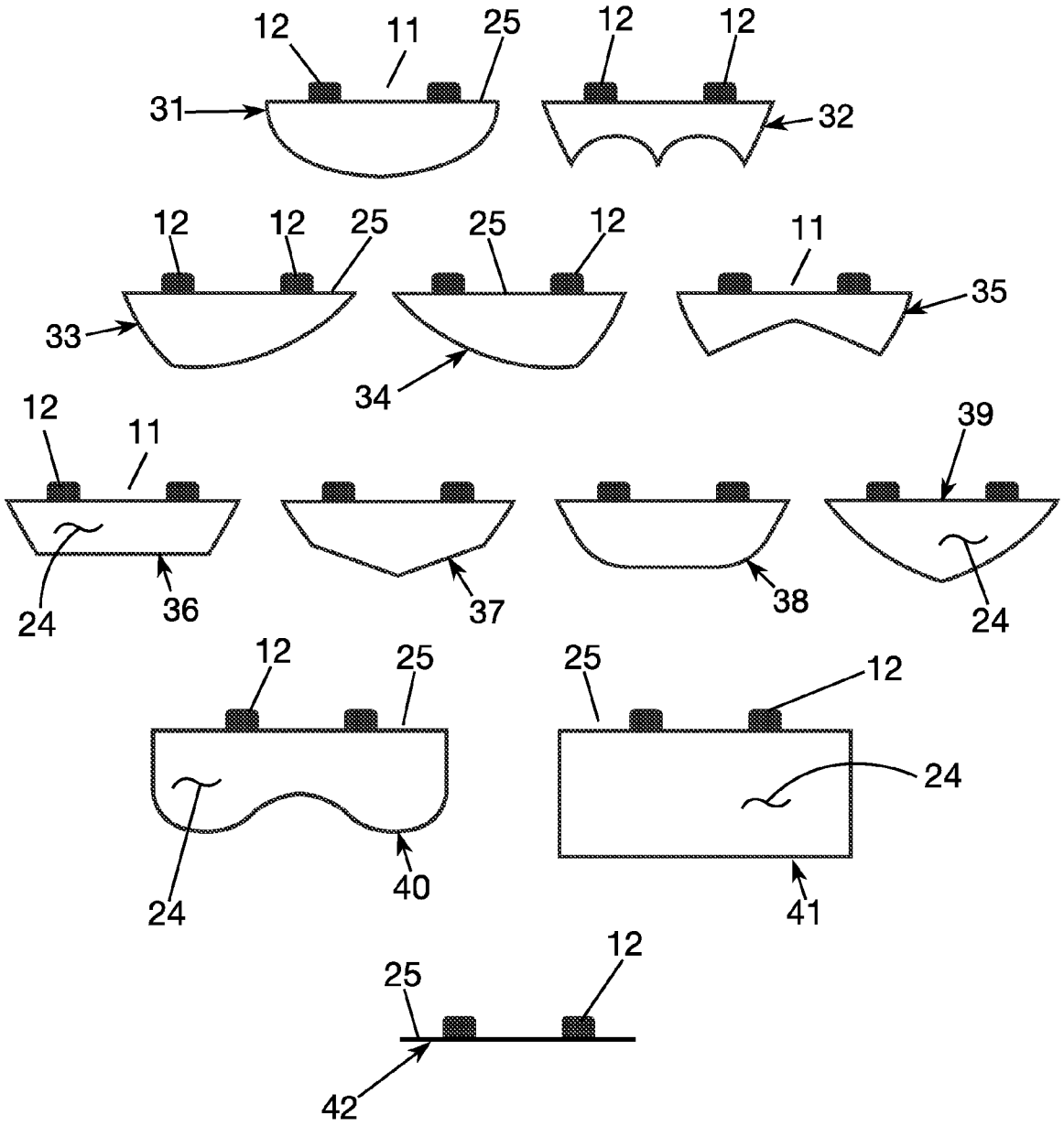
FIG. 6 is a top view of different embodiment tail blocks.

The board may also include a means for receiving and securing a variety of different board extensions, tail sections, tail plates, or tail blocks, such as those illustrated in FIG. 1B or FIG. 6. Board interface plate 6 may be used for this purpose. The securing means may include one or more spaced apart cavities 7 (also referred to as "receiving means") as shown in FIG. 2A that extend inwardly from the exposed exterior face of board interface plate 6. Securing means may include other connections consisting of male-female socket type, screw type, and so forth. The board interface plate 6 may be added to existing riding boards, such as surfboards, to provide the advantages described herein. The board interface plate 6 may be manufactured as part of the riding board 1.

In an embodiment using a foam and resin riding board such as board 1, the board interface plate 6 may be placed against the rear end 4 of the foam board body 2 and secured using fiberglass and resin as depicted in FIG. 2A. An adhesive may be combined with or without locating pins to join and secure the interface plate 6 to the rear end 4 of the board 1 prior to any external finishing such as resin, glassing, glazing, and so forth. Alternatively, the board interface plate 6 may be coupled to the rear end 4 of the board body 2 using mechanical fastening means such as screws, bolts, clasps, clamps and so forth or through adhesives or secondary applications of resin. The board interface plate 6 may be secured to a stringer 5 using adhesives, screws, or any other fastening means for additional strength.

Referring now to FIG. 1B, a top view of an embodiment interchangeable tail block 8 is shown. The tail block 8 may longitudinally extend from a forward or front section 9 to a rear tail end 10 or, simply, the tail 10. The tail block 8 may incorporate a tail faceplate 11 that is adapted to removably interconnect the board interface plate 6 (FIG. 1A) of the riding board 1. As such, the board interface plate 6 and the tail faceplate 11 have mating outwardly facing surfaces and may be planar or flat (see FIG. 2A, 16, and FIG. 3A, 25) and substantially perpendicular to the longitudinal axis of the riding board 1 in order to create a gap free connection. The board interface plate 6 and tail faceplate 11 may have the same exterior perimeter shape to minimize drag, water intrusion, or both at the mating surfaces. The tail block 8 may also include a stringer 5 (see FIG. 1A) similar to that commonly used in a surfboard.

Figure 1C:
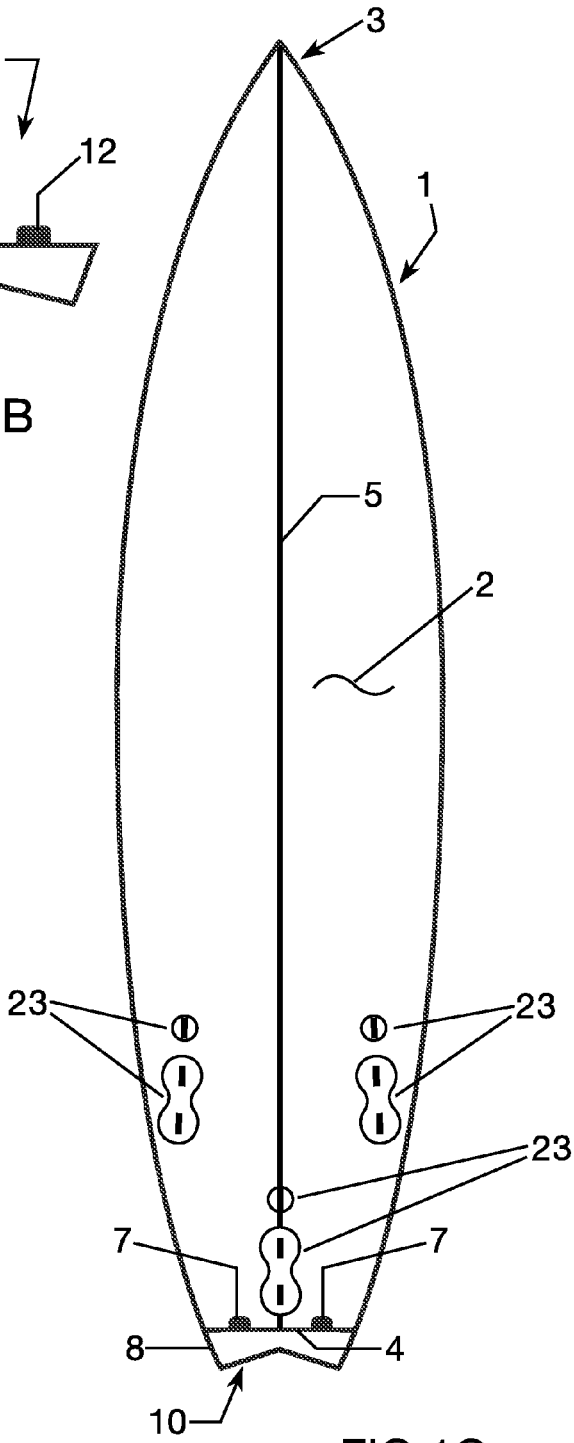
FIG. 1C is a bottom view of an embodiment riding board joined to an interchangeable tail block.

Referring now to FIG. 1C, a bottom view of an embodiment riding board 1 is joined to an interchangeable tail block 8. This combination may create a riding board 1 having different tail characteristics, with different tail blocks (see FIG. 6), or to provide other benefits such as greater floatation, additional wetted surface area, or even a protective rear end cover plate 42 for the board 1. As will be described in greater detail, coupling members 12 as illustrated in FIG. 1B, may be received by, and interconnect within, at least one cavity 7 of the board interface plate 6. The coupling members 12 may be secured to the board interface plate 6, thus preventing it from coming out during use.

Riding board 1 may include at least one fin securing means 23 as commonly found with surfboards. Fin securing means 23 may be located on a bottom surface of the surfboard or other riding board 1, forward of the board interface plate 6. The board interface plate 6 may allow full functionality as a riding board 1 when not used with a tail block 8. Fin securing means 23 may include fins that are fixed in place as part of the board 1 manufacturing process, including those boards with fiber-glassed, glued, pinned, screwed, or other securing means. Fin securing means 23 may also include other methods and means of securing the fins to the riding board 1, including allowing the fins to be removably inserted or interchanged with a different fin or fins.

In an embodiment, the fin securing means 23 are configured to allow different positioning or movement of the fins along the riding board. Such fin securing means 23 may include fin boxes and fin plugs such as those made by FCS, Future Fins, RedX, or any other means for securing the fins to a riding board as are known in the art.

In an embodiment, the fin securing means 23 may be adapted to allow at least one fin to be repositioned, slide or otherwise move relative to the tail 4. Fin securing means 23 may include multiple fin securing means to allow the fin or fins to be placed at multiple locations (twin fins, tri-fins, quad fins and the like) depending on the configuration of tail block 8 used or not used. For example, at least one of the fins (not shown) may be moved in a forward position, e.g. towards the nose 3, when the surfboard 1 is used without at tail block 8 as shown in FIG. 1A, or when the rider desires such a fin location. Alternatively, at least one fin may be moved rearward towards the tail 4 when the board 1 is configured with a tail block 8 or when the waves are fast, large or the rider prefers such configuration.

As previously disclosed, the riding board 1 may be used without a tail block 8 as shown in FIG. 1A. Alternatively, the riding board may be used in conjunction with the tail block 8 as illustrated in FIG. 1C. When used without a tail block 8, the riding board 1 has the characteristics of a shorter riding board and with a tail 4 consistent with the design of the board interface plate 6. As further shown in FIG. 1A, the board interface plate 6 is designed to provide the characteristics of a squash tail or even a square tail. The rear portion 4 and the board interface plate 6, however, may be configured so that the riding board 1 can have most any desired tail 4.

In another embodiment, adding a tail block 8 to the riding board 1 may lengthen and mimic the characteristics of a longer riding board. The riding board 1 may also include characteristics of the tail block 8.

The board interface plate 6 may be shaped in any way that allows it to be manufactured as part of the board body 2 or securely attach to any riding board 1 so it can readily mate with any version or design of the interchangeable tail block 8. For larger riding boards or those requiring greater strength, the board interface plate 6 may be secured to a stringer 5. The riding board 1 and interface plate 6 may be configured to have any tail shape configuration so long as it can be rigidly secured to the board body 2, mate with, and be secured to an opposing faceplate (FIG. 3A, 25) on the tail block 8.

Figure 2B:
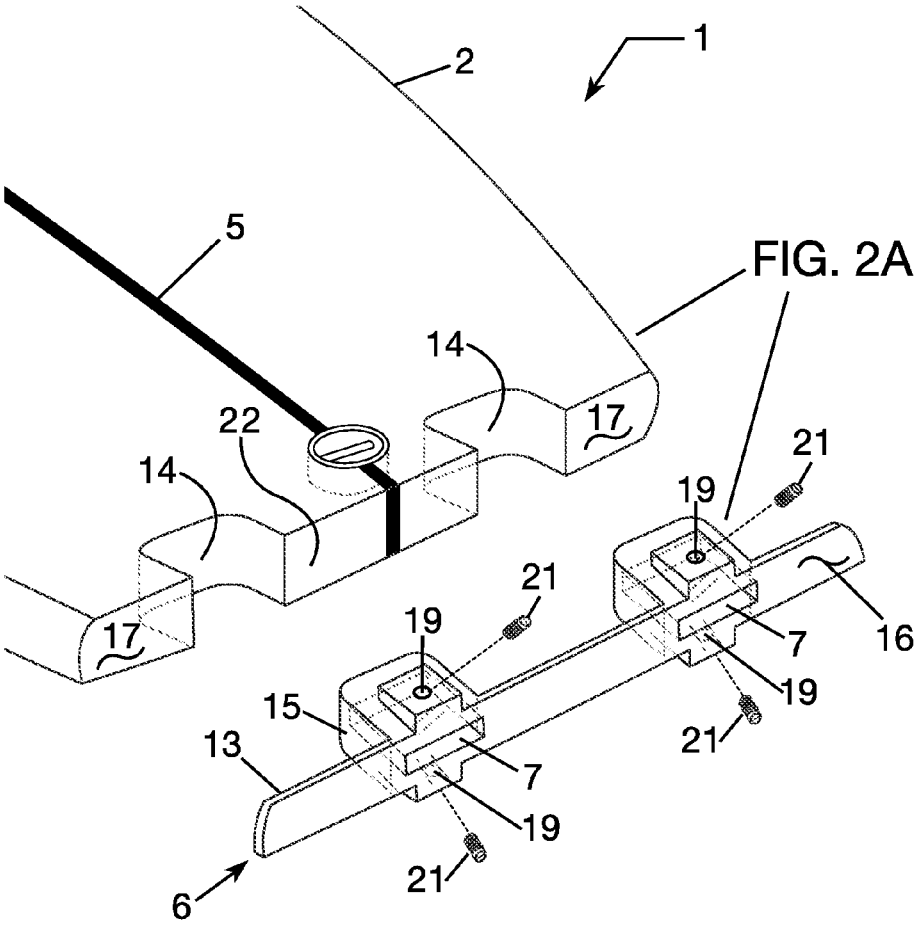
FIG. 2B is a rear view, front view, and top view of an embodiment board interface plate.
Figure 2B:
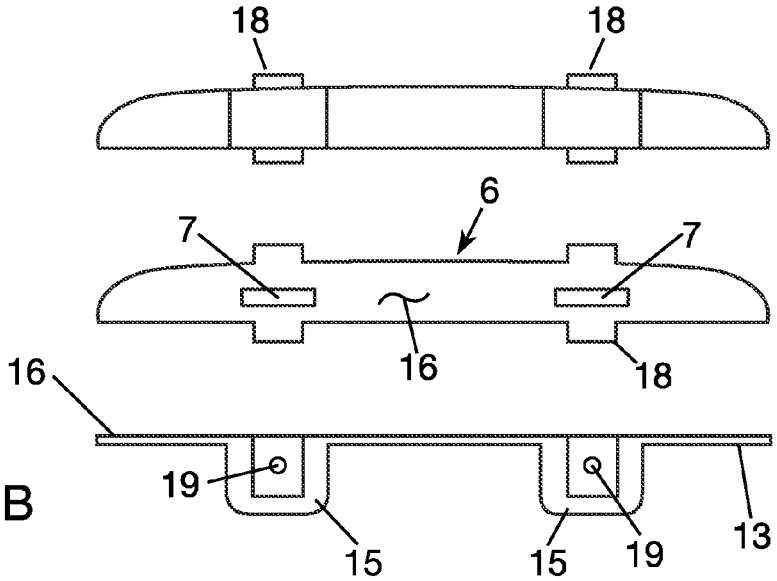

Referring now to FIGS. 2A and 2B, a preferred embodiment of the riding board 1 and board interface plate 6 of the present disclosure are shown in an exploded disassembled view along with multiple views of the board interface plate 6.

Figure 3A:
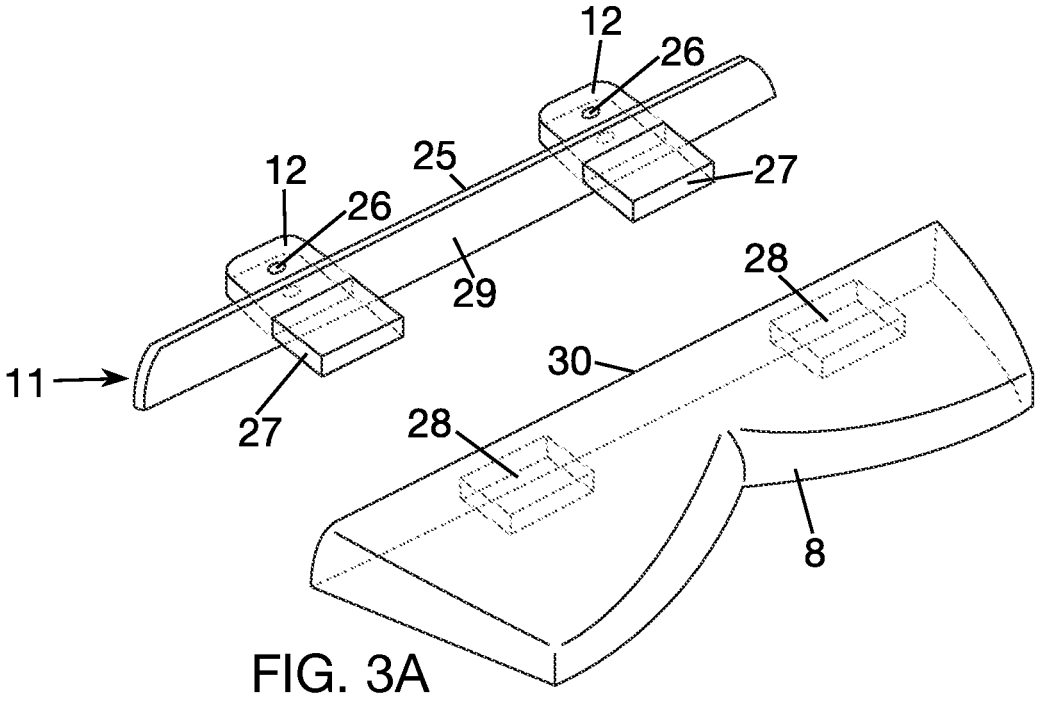
FIG. 3A is an exploded view of an embodiment interchangeable tail block.
Figure 3B:
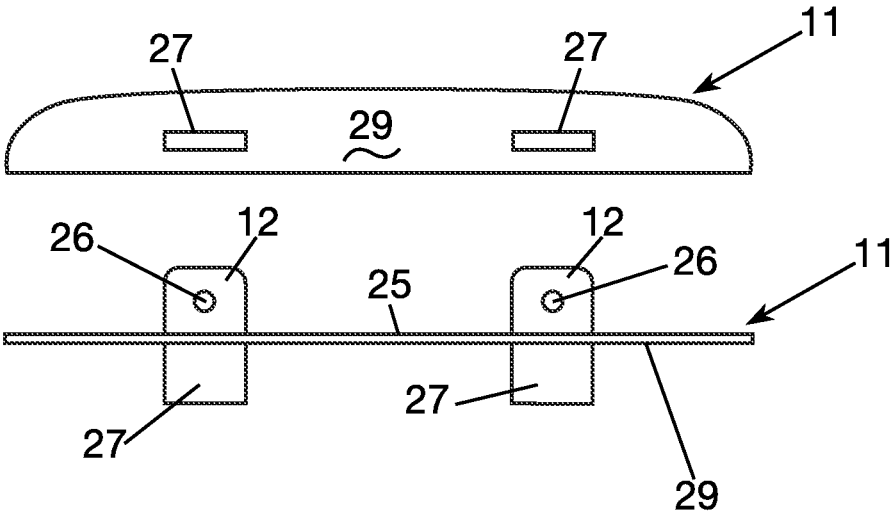
FIG. 3B is a side view and top view of an embodiment tail interface plate.

In an embodiment, the board interface plate 6 may have a substantially flat tail face plate 13 with a planar outward facing surface 16 that acts as the mating surface for abutting an opposing flat face 25 on the tail block 8 (see FIG. 3A). Alternatively, the mating surfaces can include any opposing shapes that fit together to meet the objectives described herein.

In an embodiment, board body 2 of the riding board 1 may be shaped with the rear tail section 4 adapted for incorporating or coupling with board interface plate 6. As shown in FIG. 2A, the board body 2 of surfboard 1 may be shaped during the manufacturing process to have a plurality of spaced apart notches 14. The notches 14 or other means of coupling may be sanded, shaped, routed or otherwise formed into the foam blank or other shapeable material that forms the basis of board body 2. The notches 14 are adapted to mate with receptacle blocks 15 protruding inwardly from the board interface plate 6.

In an embodiment, the notches 14 and receptacle blocks 15 have rounded mating surfaces to facilitate ease in manufacturing and aid in properly locating the interface plate 6 as well as resist lateral movement in securing the interface plate to the board body 2. Similarly, the remaining exterior face 17 of board body 2 may be generally flat or planar and adapted to fit against the mating interior surface 13 of interface plate 6. Alternatively, notches 14 and receptacle blocks 15 may have squared outer surfaces (see FIG. 4). Notches 14 may be dovetailed for receiving matching receptacle blocks, or any other compatible mating surfaces. And in a similar fashion, mating board surfaces 17 and interface plate surface 13 may have mating pins/holes, matching grooves, or other locating type features for component alignment and strength. The receptacle blocks 15 may be designed to be installed and manufactured such that the interface plate 6 is part of the board 1.

In an embodiment, the board body 2 may be shaped with the notches 14 spaced apart. Then, the receptacle blocks 15 of interface plate 6 may be mated within the notches 14 of the board body 2 and the remaining interior surface 13 of the interface plate, or most of it, may be mated flat against the remaining exterior surface 17 of the rear end 22 of the riding board body 2. Adhesives may be applied and then the board body 2 may be coated with a fiberglass, resin, epoxy, urethane, polymer, composite resin, or other coating as is known in the art. Although the notches 14 and receptacle blocks 15 are illustrated as rounded, square and rectangular, they may be formed in any shape, including mating triangular wedges or trapezoidal dovetails, such that when mated together, board interface plate 6 may be retained against board body 2 and restrained from moving rearward. Similarly, any desired mating shapes may be used to better restrain lateral, longitudinal or any other forces as desired.

As shown in FIGS. 2A and 2B, receptacle block 15 or receptacle blocks may each advantageously include a manufacturing surface or tab 18. Each tab 18 may extend upwardly and downwardly from the top (also referred to as "riding surface") and bottom surfaces of the riding board body 2. The manufacturing tabs 18 each include a fastener receiving means 19, such as a threaded screw hole, pinhole or other similar opening, which extends through a tab 18, a receptacle block 15, and into a tail block tab receiving cavity 7.

In an embodiment, the fastener receiving means 19 may extend into each receiving cavity 7 at an angle approximately between 30 and 70 degrees from a longitudinal axis of the board body 2, and preferably at about a 50 degree angle. Each fastener hole 19 may be adapted to receive a fastener means 21 such as a bolt, screw, ball pin, locking pin and so forth. In an embodiment, the fastener receiving means 19 may be internally threaded and the corresponding fastener means 21 may be a removable, externally threaded screw with a hex head, Phillips head, slotted head, or the like. Each fastener means 21 may be sufficiently long so as to penetrate into the corresponding cavity 7 without protruding from the outside of the fastener hole 19 or board body 2. In a typical surfboard, the preferred length of a screw may be about three-eighths inch long. At least one fastener means 21 may be used to secure a coupling tail tab 12 within each cavity 7, thus securing tail block 8 to the board interface plate 6 and, thus, to riding board 1.

Figure 4:
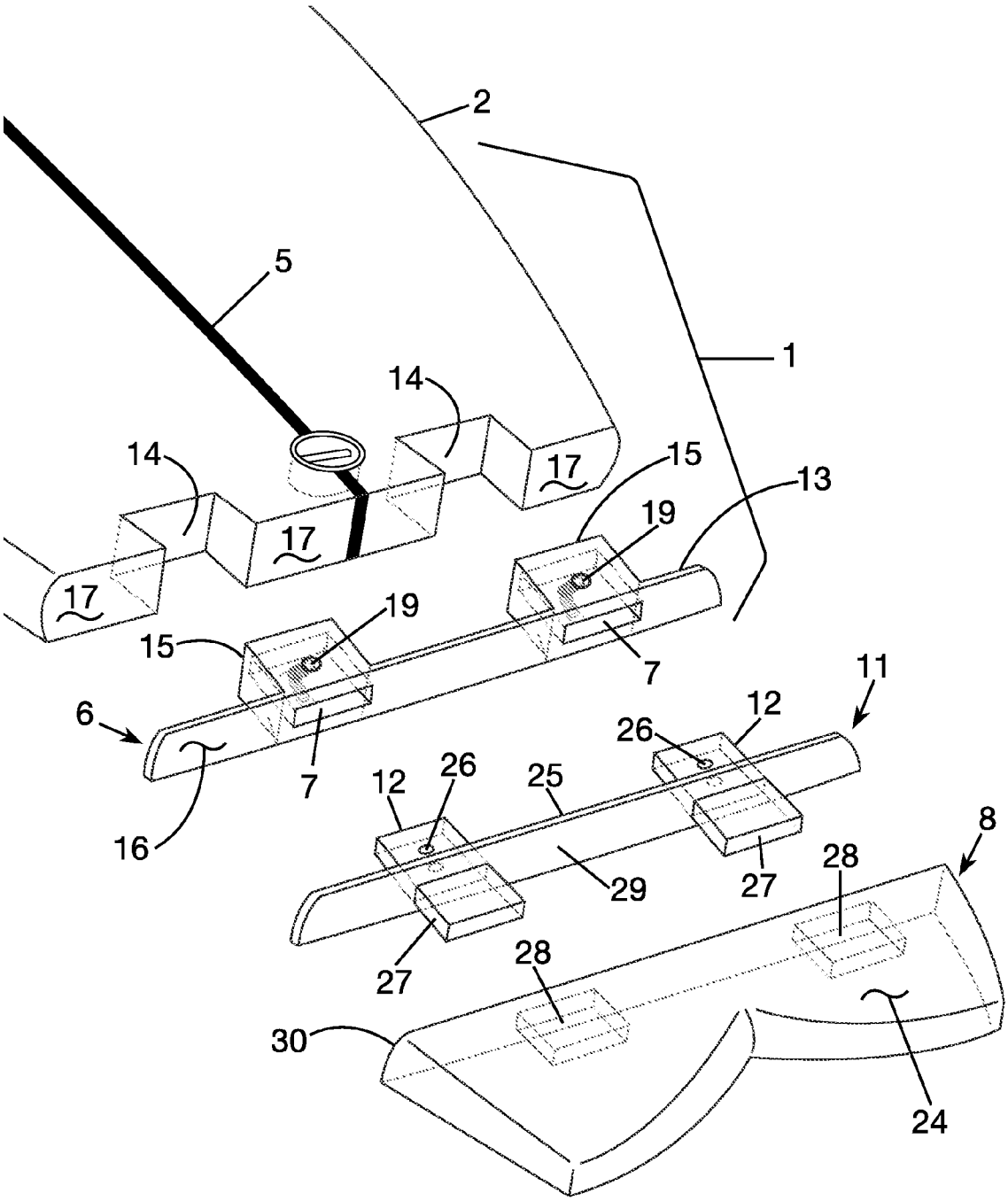
FIG. 4 is an exploded view of an embodiment riding board.

The manufacturing tabs 18 may advantageously allow for the efficient production of the riding board 1 while protecting the fastener receiving means 19 from being covered with fiberglass, plastic resin, or other coating during the board manufacturing process. Either during the coating process or thereafter, the tabs 18 may be sanded flush or otherwise removed, as shown in FIGS. 4 and 5, so that the upper and lower surfaces of the interface plate 6, and particularly, the receptacle blocks 15, may not protrude out from either the bottom or top surface of the board 1. Thus, the tabs 18 may prevent damage or blockage of the faster receiving means 19 during the manufacturing process.

Referring now back to FIG. 1A, the riding board 1 may be ridden without a tail block 8, extension (not shown) or even without a board interface cover plate 42. The riding board 1 without a tail block 8 may be further advantageous in that it is shorter for transportation, or may be fitted with a padded or otherwise protective tail end 40, or an interface cover plate 42 as shown in FIG. 6. The protective tail end 40, and interface cover plate 42 may be made from an elastomeric, plastic, or other soft compliant material to not only absorb impacts but to also provide friction that may prevent the riding board from shifting during upright storage. Furthermore, the board interface plate 6 has a less brittle rear end 4 that may not be subject to fracture, dings and cracking like the tail of traditional fiberglass or epoxy boards. Another distinct advantage of the present disclosure is that the present riding board 1 may also be used with a variety of interchangeable tail blocks 8, such as those shown in FIG. 6.

Referring now to FIG. 4, the tail block 8 includes tail faceplate 11, which may be adapted to secure with mating surface 30 of tail block body 24. The tail faceplate 11 may be made from a plastic, including a reinforced plastic that is strong and rigid but does not easily crack or break. Moreover, the plastic should be resistant to ultraviolet rays and exterior exposure to provide long-term use.

Tail faceplate 11 may include at least one coupling tail tab 12. Each coupling tail tab 12 extends outwardly from a planar outer surface 25 of the tail faceplate 11 and may be adapted to engage a cavity 7 of the board interface plate 6. Each coupling tail tab 12 may be sized to mate with and tightly fit within the similarly shaped cavity 7 of board interface plate 6. Moreover, each coupling tail tab 12 may be fitted with an indent 26, slot, dimple, hole, recess, or other means for contact with and/or receiving at least a portion of a fastener means 21 inserted through a respective fastener receiving means 19. Alternatively, the fastener means 21 may simply impinge the coupling tail tab 12, functioning equivalent as a setscrew, to secure it within each cavity 7.

Tail faceplate 11 may also include means for supporting the body of the tail block 8. A tail support tab member 27 or spaced apart tail support tab members 27 may advantageously help secure the tail block body 24 to the inner surface 29 of the tail faceplate 11 while providing structural support for the tail block 8 relative to the riding board 1. Because the tail block 8 may encounter a variety of forces while being ridden, including being stepped on by the rider, tail support tab 27 or tail support tabs 27, may be varied in number, size, material, and strength or any combination thereof, to accommodate the need of the particular board application and desired strength or other characteristics. The coupling tail tabs 12 and tail support tabs 27 may be made from a strong or reinforced plastic or composite such as a fiberglass or Kevlar. Alternatively, the interface plate 6 and tail faceplate 11 or parts thereof may be made from any strong and generally rigid material, including aluminum, stainless steel, titanium or any other metal or plastic as would be known in similar manufacture. Tail faceplate 11 and particularly coupling tail tabs 12 and tail body securing tabs 27 may be made from different materials, rigid or semi rigid, or be of differing numbers of sizes so as to provide differing flex characteristics of the tail block 8 relative to the body 2 of the riding board 1. In an embodiment, the connection between the board 1 and the tail block 8 may be rigid with minimal flex. In an embodiment, the connection between the board 1 and the tail block 8 may be flexible.

Similar to the manufacture of the riding board 1, the shaped tail body 24 of tail block 8 may be secured to the tail faceplate 11 as part of the manufacturing process. The shape of tail body 24 may be formed or shaped from foam similar to the methods of shaping a surfboard. Alternatively, the tail body 24 may be shaped from any other materials as known in the art or even extruded or molded into the desired tail configuration. Before or as part of the shaping or molding process or even after forming the body of the tail block 8, an inner tail cavity 28 or plurality of spaced apart inner tail cavities are made therein and adapted for receiving the support tabs 27. Depending on the materials used and method of manufacture, the tail body 24 may then be coated with a fiberglass resin, epoxy or any other coating similarly to the manufacture of a surfboard.

In the embodiment shown and further shown in FIG. 4, tail cavities 28 have a square or rectangular opening and are configured such that they match and mate with the similarly shaped support tabs 27 of the tail faceplate 11. Similar to the construction of interface plate 6 to the body 2 of the riding board 1, the matching mating shapes aid in properly locating the tail faceplate 11 relative to the body of the tail block 8 and aid in resisting lateral or flexing movement while also securing the interface plate to the board body 2. Although a rectangular shape is shown, any matching and mating shape may be used.

Once the tail faceplate 11 is mated to the body 24 of the tail block 8 and the support tabs 27 are fully inserted within the cavities 28 of the tail body, the two components may be coupled and the tail block body finished by coating two joined pieces with a plastic such as a fiberglass, epoxy or composite resin as is known in the art. Alternatively, or in addition, the tail faceplate 11 and support tabs 27 may be secured to the body of the tail block 8 using an adhesive coated to the mating surfaces 29 and 30. Alternatively or in conjunction with adhesives or resin, fasteners may be used through the cavities 28 and into support tabs 27 or through the tail faceplate 11 and into the tail block body 24 or as is known in the art of securing such materials. Alternatively, the tail block body 24 may be formed, for example with any expanded foam and the tail faceplate 11 integrated as part of the plastic and forming process. Coupling tail tabs 12 and support tabs 27 should be made from a single piece of lightweight and strong material and configured for insertion into tail faceplate 11 and tail block body 24 similar to an expanding anchor type fastener used in construction.

Referring now to FIG. 4, an exploded view of an alternative embodiment shows a riding board 1 and board interface plate 6 opposing an exploded view of an embodiment of a tail block 8. The exterior mating surface 16 of the board interface plate 6 is shown opposing the mating surface 25 of the tail faceplate 11.

Figures 5A, 5B:
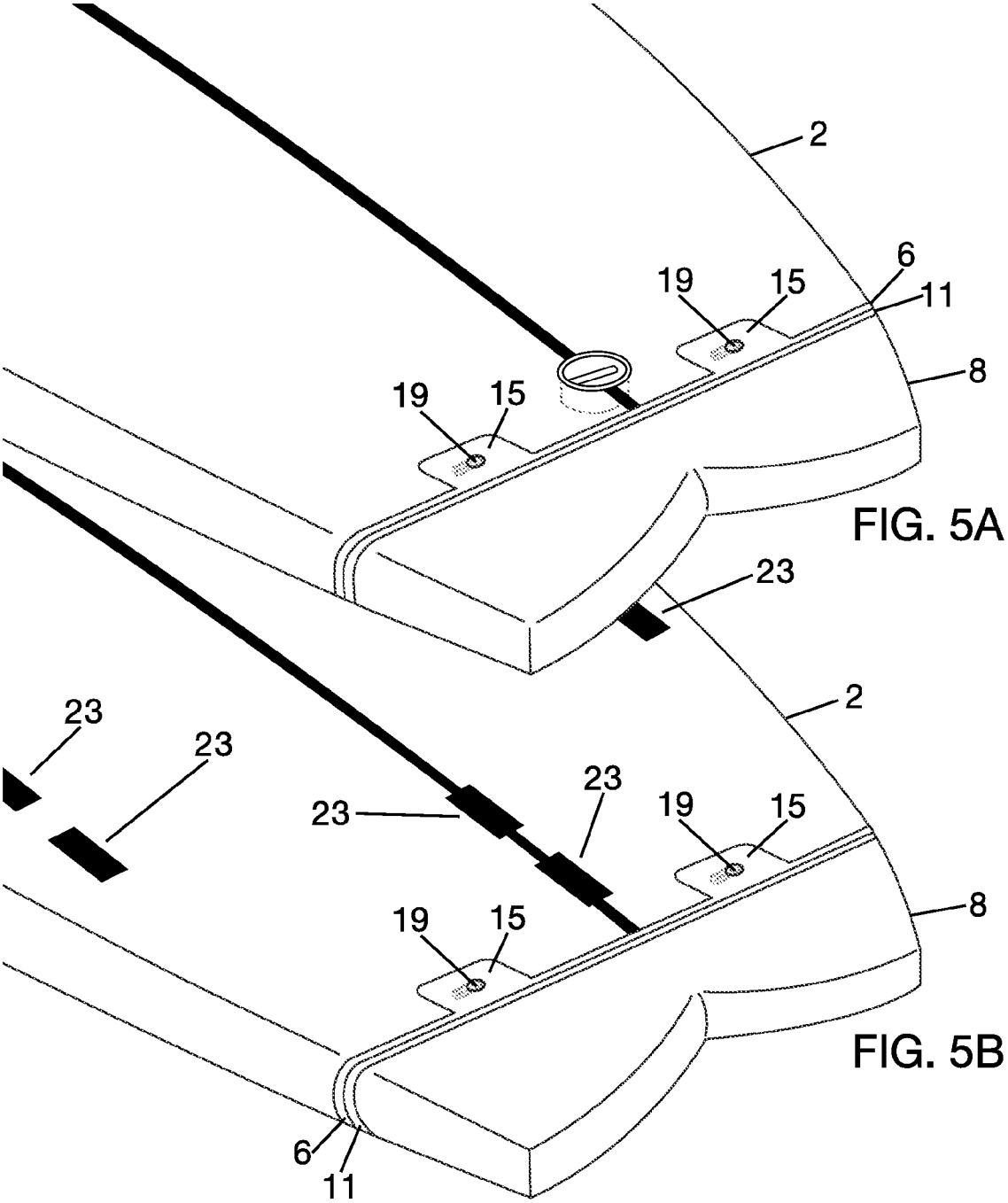
FIG. 5A is a top view of an embodiment riding board joined to a tail block.
FIG. 5B is a bottom view of an embodiment riding board joined to a tail block.

Referring now to FIGS. 5A and 5B, an embodiment of the riding board 1 of the present disclosure is shown coupled with a tail block 8. The riding board 1 shows the receptacle blocks 15 without manufacturing tabs or after they have been sanded down and removed. In addition, fastener means 21 are countersunk into the fastener receiving means 19 so they do not protrude above the outer surface of the body 2 of the board 1. Board interface plate 6 and tail faceplate 11 are shown having common exterior perimeters providing a smooth continuous surface between the board body 2 and the tail block 8.

FIG. 6 shows a variety of embodiments of tail blocks 8 (also referred to as "tail plates"), each including tail faceplate 11, and including coupling tail tabs 12 as described herein. Each of the tail block shapes shown, including: thumb 31, bat shape 32, left asymmetrical 33, right asymmetrical 34, swallow 35, square 36, diamond 37, squash 38, and pintail 39 represent just a few of the possible shapes that may be utilized with the present disclosure. Moreover, each shape may be extended to any length to create a greater overall riding board 1 length or extending tail.

In an embodiment, tail block 40 may be advantageously configured as a travel tail. In this embodiment, the tail block 40 may be constructed of a padded type material so as to protect the rear section 4 and/or tail of the riding board 1. For example, tail block 40 may be constructed of foam, such as a polyethylene, polyurethane or polystyrene, that may have a greater diameter (width and height) than the board body 2 so as to provide protection. Alternatively, tail block 40 may be made from any material that can absorb impacts and provide protection to the board 1. Tail block 40 may be designed to be coupled to a riding board 1 during transportation and storage, and then removed during use. Tail block 40 may advantageously be made from an inexpensive material offering protection for little cost to the user.

In another embodiment, tail block 41 may be constructed from a shapeable material of a larger generic size and designed to allow the end user to create any desired shape. In this embodiment, the "unshaped" tail block may be provided with the tail faceplate 11 already secured to the tail body 24. The tail body 24 may be made from a closed-cell foam, soft or moldable plastic, sealed wood, foam with plastic coating, water resistant clay, or other material allowing for manual shaping, including shaping by filing, sanding, heat shaping and the like, and finishing by a typical board rider or surfing enthusiast. In one example, the body 24 of tail block 41 may be made from closed-cell polyethylene foam that may be secured to the tail faceplate 11. Tail block 41 advantageously allows a user to experiment with different shapes, sizes, lengths, widths and almost any configuration imaginable and all without the expense of buying a new riding board.

As a distinct advantage of the present disclosure, most any shape tail body 24 or extension may be secured to the tail faceplate 11 of the present disclosure to create almost any configuration of tail block 8 desired. The tail block 8 may be made in any size, including any desired thickness. Moreover, the tail block 8 may be made from multiple different materials to create different flexes as well as from materials different than the riding board 1.

Figure 7:
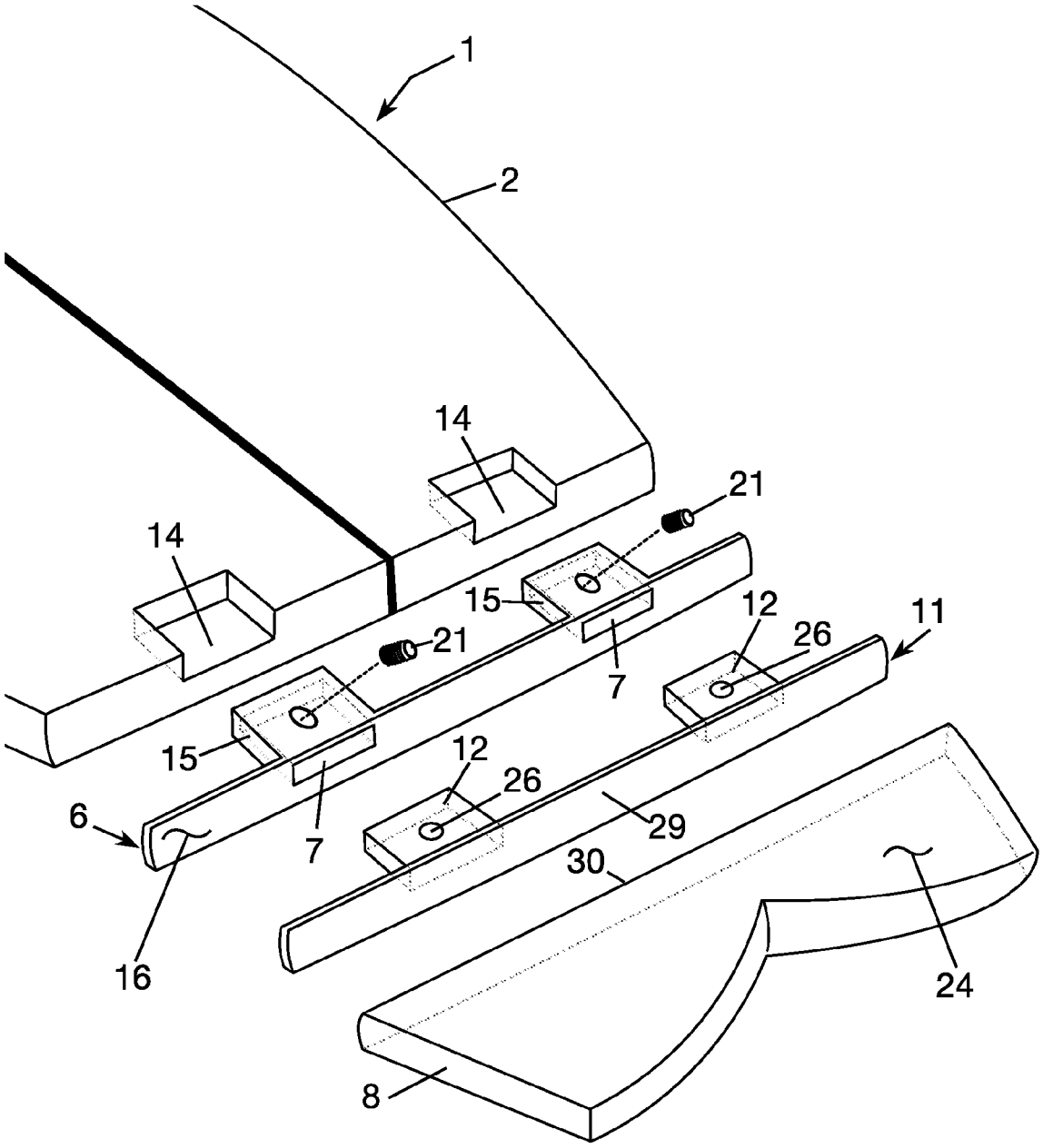
FIG. 7 is an exploded view of another embodiment riding board.

FIG. 7 shows an alternative embodiment of the riding board 1. In this embodiment, the rear end of the riding board 1 includes notches 14 that are adapted to receive partial height receptacle blocks 15 protruding inwardly from board interface plate 6. The partial notch or notches 14 do not cut through the entire thickness of the board body 2. The partial notches 14 could be any configuration that facilitates the manufacture of the present board 1, while maintaining the strength of the body 2 and board interface plate 6 connections. Similarly, the receptacle blocks 15 may be configured to closely fit into the partial notches 14 so the interface plate 6 may be secured to the board body 2 as previously discussed. There may be no manufacturing tabs as part of the exterior of the interface plate 6.

In yet another embodiment as shown in FIG. 7, tail faceplate 11 only includes coupling members 12. Each coupling member 12 includes a dimple, hole, or other means 26 for receiving and coupling with a pin, fastener or other removable coupling means 21. The tail block body 24 may be secured to the interior surface 29 of tail faceplate 11 through an adhesive or a fastener or fasteners (not shown) securing the inner surface 29 to the tail body 24. The exterior perimeter shape of the tail faceplate 11 may be the same as that of the tail body 24 such that the inner surface of the faceplate butts up flat against the inner face 30 of the tail block body 8. Similarly, and for larger riding boards 1, notch 14 or notches, and any number of them, may be centered into the rear end of the board body 2 so as to facilitate the placement and securing of the board interface plate 6 to the body 2.

The present disclosure is directed to both applications with existing surfboards and riding boards that may be adapted for use with an interchangeable tail block 8 by adding the described board interface plate 6 as well as for use as part of a configurable riding board. For example, a conventional fiberglass and foam core riding board may be adapted for use with the present disclosure by removing a portion of the current rear end or tail section 4. This may be accomplished by cutting, sanding or grinding away material as is well known in the art of manufacturing riding boards made from fiberglass. Once enough material or even additional material if desired is removed, a board interface plate 6 may be placed against and secured to the modified rear end. As noted, this may be accomplished with adhesives, fasteners, securing to a stringer or any other method as well known in the art. The board interface plate 6 may be sized to fit against the board body 2 without protrusions and may need to be sanded or formed for a proper fit. Once placed, the board interface plate may be sealed to prevent entry of water or other material into the board body. The board interface plate and board body may be jointly glassed or epoxied to be made as a singular riding board unit.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A configurable riding board comprising:

a riding board body extending longitudinally from a front end to a rear end, with the riding board body further defined by a riding surface and a bottom surface, the rear end further comprising notches to receive a board interface plate;

the board interface plate coupled to the rear end of the riding board body and having an outer surface facing away from the rear end of the riding board body, said interface plate further comprising a plurality of spaced apart cavities extending inwardly from the outer surface on the board interface plate and receptacle blocks that outwardly protrude to engage the rear end of riding board body; and a tail block having a forward surface that removably couples to the board interface plate, wherein the forward surface has a plurality of tabs to engage the board interface plate cavities.

2. The riding board of claim 1 wherein the outer surface of the board interface plate is substantially flat and is substantially perpendicular to a longitudinal axis of the riding board.

3. The riding board of claim 1 wherein the cavities extend into the riding board body and are housed within the board interface plate receptacle blocks.

4. The riding board of claim 1 wherein the removable tail block forward surface comprises a tail block interface plate that couples the tail block to the board interface plate.

5. The riding board of claim 1 further comprising a tail plate removably coupled to the board interface plate wherein the tail plate covers the cavities of the board interface plate.

6. The riding board of claim 1 further comprising at least one fastener to removably secure the tail block to the riding board.

7. The riding board of claim 1 wherein the tail block further comprises exterior surfaces that are flush with the riding surface and bottom surface of the riding board body when coupled to the board interface plate.

8. The riding board of claim 1 wherein the board interface plate further comprises a circumferential exterior surface that is flush with the riding and bottom surfaces of the riding board body when coupled to the riding board body.

9. A configurable riding board comprising:

a tail block having a body extending from a forward surface along a longitudinal axis to a rear end and shaped to be a tail of the riding board, wherein the forward surface is substantially flat and is substantially perpendicular to a longitudinal axis of the riding board with the forward surface further comprising a plurality of spaced apart coupling members protruding outwardly from the forward surface and adapted to removably engage a plurality of spaced apart cavities within a rear end of a board interface plate, wherein the board interface plate is coupled to the rear end of the riding board body, said board interface plate further comprising a plurality of spaced apart cavities extending inwardly from a rearward surface and receptacle blocks that outwardly protrude from a forward surface to engage the rear end of a riding board body.

10. The riding board of claim 9 further comprising at least one fastener to removably couple the tail block to the riding board body.

11. A configurable riding board comprising:

a riding board body extending along a longitudinal axis from a front end to a rear end, the rear end further comprising notches to receive a board interface plate;

the board interface plate comprising receptacle blocks that forwardly protrude and connect to the rear end of the riding board, and having a substantially flat rear surface facing away from the rear end, said board interface plate having a plurality of spaced apart cavities that inwardly extend substantially perpendicular to the rear surface; and a tail block having a forward surface that removably couples to the board interface plate, said forward surface having a plurality of spaced apart tabs that outwardly protrude substantially perpendicular to the forward surface and engage the plurality of spaced apart cavities.

* * * * *